US010016879B2

(12) United States Patent
Liou

(10) Patent No.: US 10,016,879 B2
(45) **Date of Patent: *Jul. 10, 2018**

(54) ADJUSTABLE WRENCH WITH REINFORCED STRUCTURE

(71) Applicant: Mou-Tang Liou, Taichung (TW)

(72) Inventor: Mou-Tang Liou, Taichung (TW)

( * ) Notice: Subject to any disclaimer, the term of this patent is extended or adjusted under 35 U.S.C. 154(b) by 378 days.

This patent is subject to a terminal disclaimer.

(21) Appl. No.: 14/687,962

(22) Filed: Apr. 16, 2015

(65) Prior Publication Data

US 2016/0303713 A1 Oct. 20, 2016

(51) Int. Cl.
*B25B 13/14* (2006.01)

(52) U.S. Cl.
CPC ..... *B25B 13/14* (2013.01)

(58) Field of Classification Search
None
See application file for complete search history.

(56) References Cited

U.S. PATENT DOCUMENTS 1,376,721 A * 5/1921 Mueller ..... B25B 13/16 81/165
1,652,977 A * 12/1927 De Vilbiss ..... B25B 13/14 81/158
2009/0217790 A1* 9/2009 Harter ..... B25B 13/14 81/129

FOREIGN PATENT DOCUMENTS

TW M455598 U 6/2013

* cited by examiner

*Primary Examiner* — Joseph J Hail
*Assistant Examiner* — Brian Keller
(74) *Attorney, Agent, or Firm* — Alan D. Kamrath; Kamrath IP Lawfirm, P.A.

(57) ABSTRACT

An adjustable wrench includes a frame and a movable jaw. The frame includes a handle, a fixed jaw, a guiding slot, a hole, and a holding portion. The guiding slot is formed between the handle and the fixed jaw. The hole communicates with the guiding slot. An adjusting screw is rotatably engaged in the hole. The movable jaw includes a guiding portion slidably engaged in the guiding slot. A supporting portion and an adjusting portion are formed at the bottom side of the guiding portion. The supporting portion abuts against the holding portion, and the adjusting portion is engaged with the adjusting screw.

10 Claims, 14 Drawing Sheets

ADJUSTABLE WRENCH WITH REINFORCED STRUCTURE

BACKGROUND

The present invention relates to an adjustable wrench and, more particularly, to an adjustable wrench with a reinforced structure to withstand a larger torque.

Taiwan Utility Model No. M455598 discloses an elongated adjustable wrench including a handle and a head. The handle includes a body, an elongated portion, and a hang hole. The body includes at least one through slot extending therethrough. The elongated portion is formed on the body and adjacent to the at least one through slot. The hang hole extends through an end of the body. The head is formed on an end of the handle opposite to the hang hole and includes a fixed jaw, a movable jaw, and a thumb screw. The fixed jaw integrally extends from the end of the handle opposite to the hang hole and includes a groove formed between the fixed jaw and the handle for receiving the movable jaw. The movable jaw is slidably connected to the fixed jaw. The thumb screw is rotatably disposed in the fixed jaw and engaged with a rack piece of the movable jaw.

However, when the elongated adjustable wrench turns a workpiece, the fixed jaw and the movable jaw slightly move opposite each other due to a counteracting force produced from the torque applying on the workpiece. Thus, a part of the movable jaw adjacent to the groove will be damaged easily because the groove extends through a bottom side of the fixed jaw to reduce the structural strength of the adjustable wrench. Furthermore, the movable jaw is guided by two side walls of the groove. Thus, the two side walls of the groove are also easy to be deformed because the rack piece of the movable jaw pushes against the two side walls of the groove under the counteracting force.

Thus, a need exists for an adjustable wrench with a reinforced structure to avoid the drawbacks of the conventional structure.

BRIEF SUMMARY

An adjustable wrench according to the present invention includes a frame and a movable jaw. The frame includes a handle, a head connected to an end of the handle, and a fixed jaw formed on an end of the head opposite to the handle. A working face of the fixed jaw defines a first datum plane. A guiding slot extends through the head along an axis and is formed between the handle and the fixed jaw. The head includes a first lateral side and a second lateral side opposite to the first lateral side. The first and second lateral sides are respectively disposed at two opposite sides of the first datum plane. The working face of the fixed jaw faces the first lateral side. A reverse face of the fixed jaw faces the second lateral side. A hole is formed through the head. A top section of the hole communicates with the guiding slot. The hole is disposed between the first datum plane and the second lateral side. An adjusting screw is rotatably engaged in the hole. A holding portion is formed in the head and extends from the first lateral side to an axial extent along the axis. The holding portion is disposed at an end of the guiding slot opposite to the fixed jaw.

The movable jaw is slidably connected to the head of the frame and faces the fixed jaw. The movable jaw includes a guiding portion formed along a reference line. The guiding portion is slidably engaged in the guiding slot. The reference line and the axis are alternatively overlaid upon or parallel to each other. A supporting portion is formed at a bottom side of the guiding portion. The supporting portion abuts against the holding portion. An adjusting portion is formed at the bottom side of the guiding portion adjacent to the supporting portion to engage with the adjusting screw.

The holding portion includes a holding face disposed in the guiding slot. The holding face facing the fixed jaw is flat and extends along a direction parallel to the axis. The supporting portion includes an abutting face abutting against the holding face. The abutting face is flat and extends along a direction parallel to the reference line.

In an example, the frame includes a groove longitudinally extending through the head and communicating with the guiding slot. The groove is disposed between the first datum plane and the second lateral side. The guiding portion includes a positioning slot extending along the reference line and corresponding to the groove. A positioning member inserts through the groove to engage into the guiding slot and the positioning slot.

In another example, the head of the frame includes a positioning recess formed at a periphery of the guiding slot along the axis and communicating with the guiding slot. The guiding portion includes a positioning portion formed at a side thereof along the reference line to correspond to the positioning recess. The positioning portion is engaged in the positioning recess.

A working face of the movable jaw defines a second datum plane which is not parallel to the first datum plane to form an included angle of less than two degrees.

The hole is arranged at a side of the guiding slot opposite to the fixed jaw. A pivot inserts into the hole through a direction parallel to the axis and passes through the adjusting screw rotatably engaged in the hole. The adjusting portion is formed at a side of the guiding portion adjacent to the hole.

In an example, the adjusting screw is a nut with a threaded hole, and the adjusting portion is a threaded rod with a threaded section. The threaded hole of the adjusting screw is rotatably engaged with the threaded section of the adjusting portion along the reference line.

The positioning member and the groove substantially have rectangular cross-sections, respectively.

In an example, the guiding slot and the guiding portion substantially have circular cross-sections, respectively.

In another example, the guiding slot and the guiding portion substantially have hexangular cross-sections, respectively.

The present invention will become clearer in light of the following detailed description of illustrative embodiments of this invention described in connection with the drawings.

DESCRIPTION OF THE DRAWINGS

The illustrative embodiments may best be described by reference to the accompanying drawings where.

Figure 1:
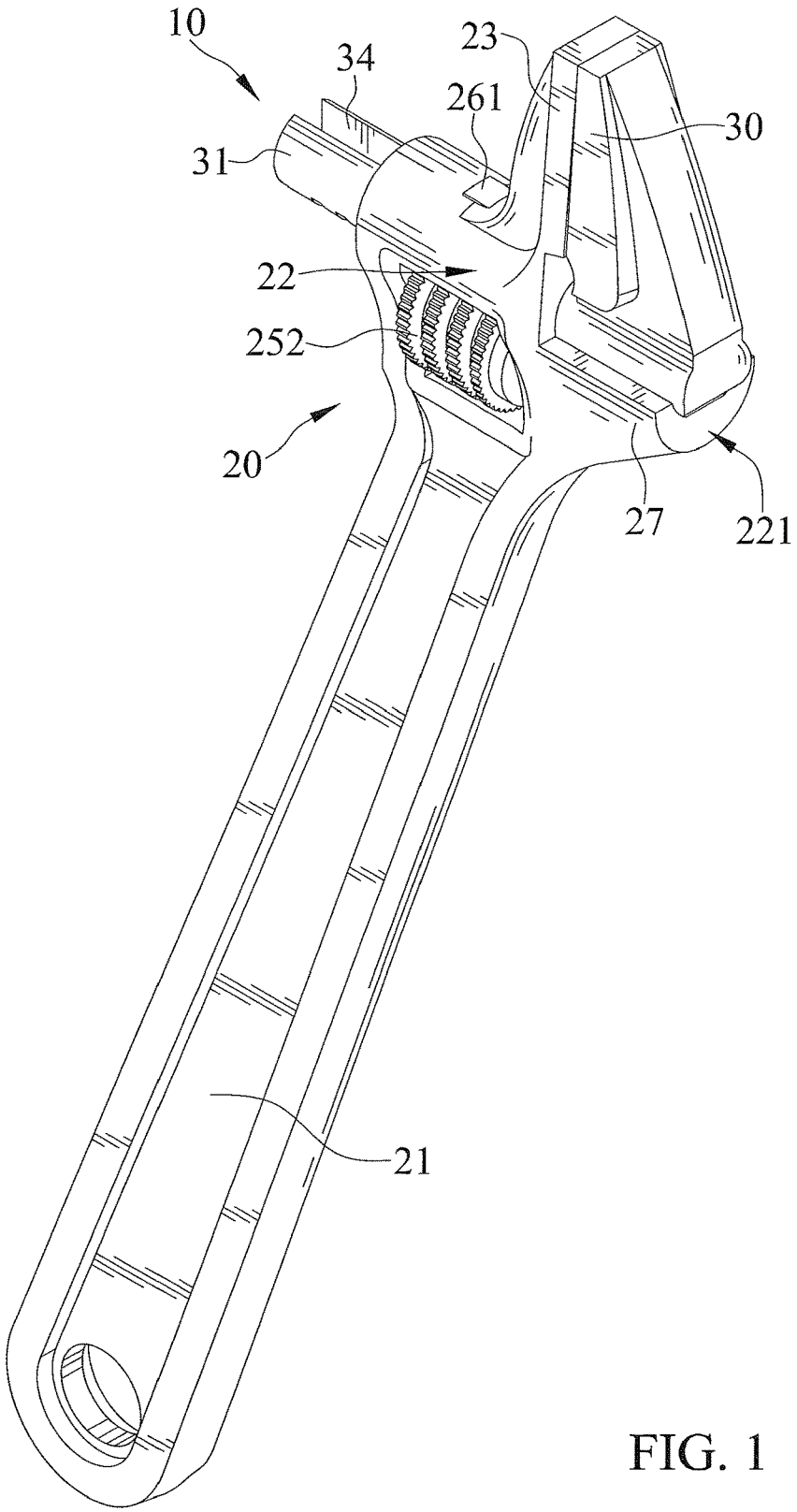
FIG. 1 is a perspective view of an adjustable wrench of a first embodiment according to the present invention.
Figure 2:
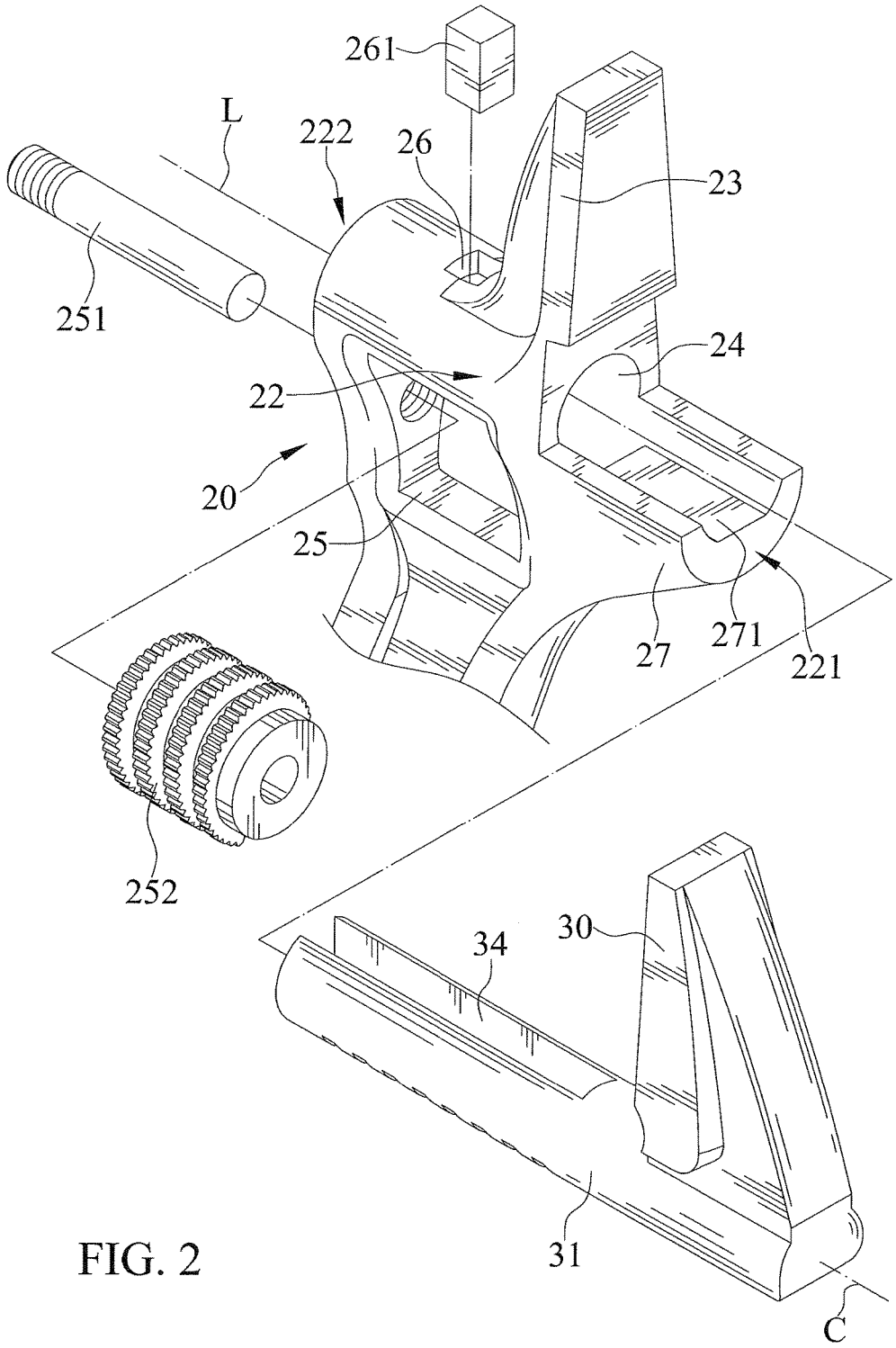
FIG. 2 is a partial, exploded, perspective view of the adjustable wrench of FIG. 1.
Figure 3:
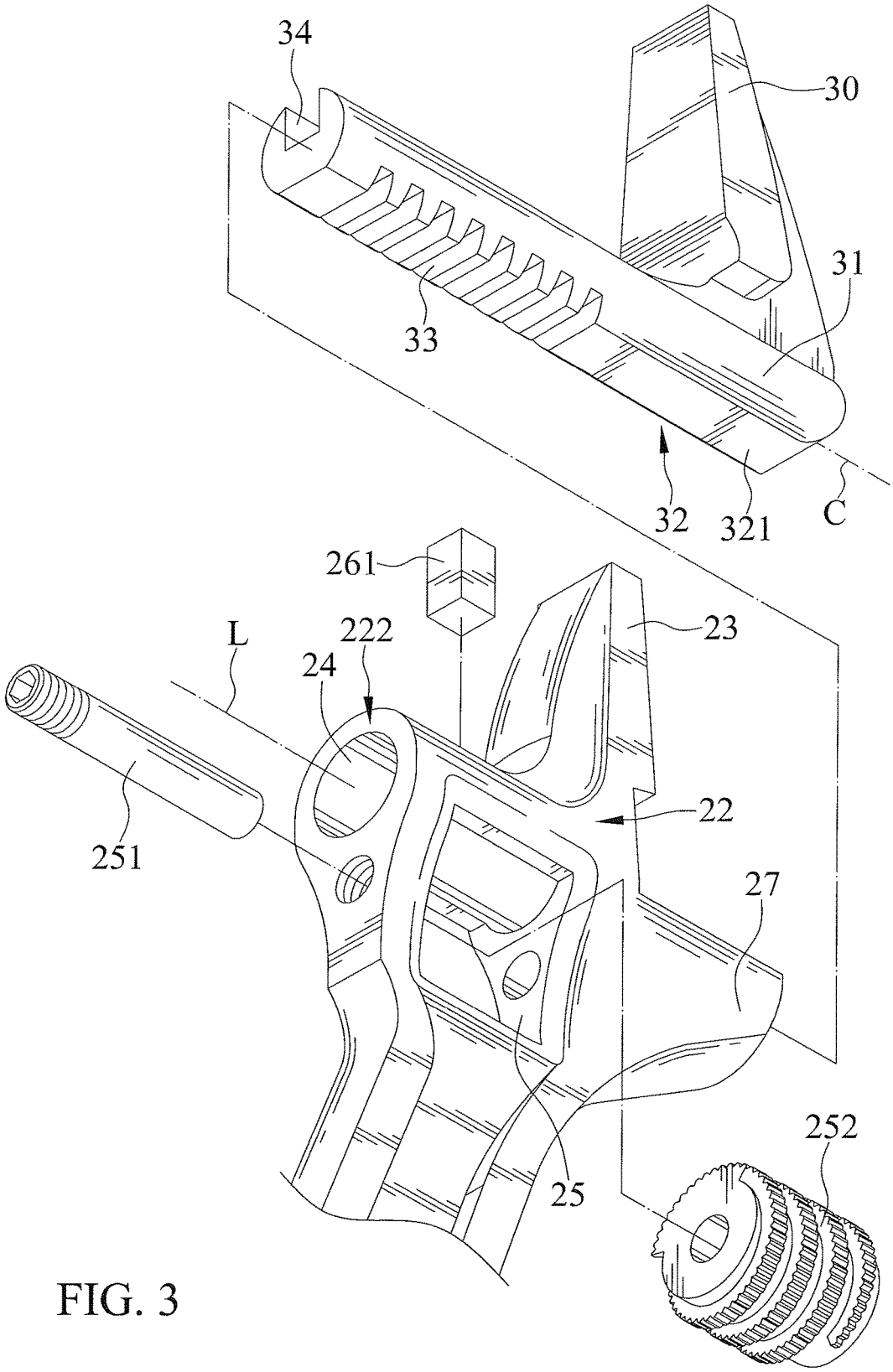
FIG. 3 is another partial, exploded, perspective view of the adjustable wrench of FIG. 1.
Figure 4:
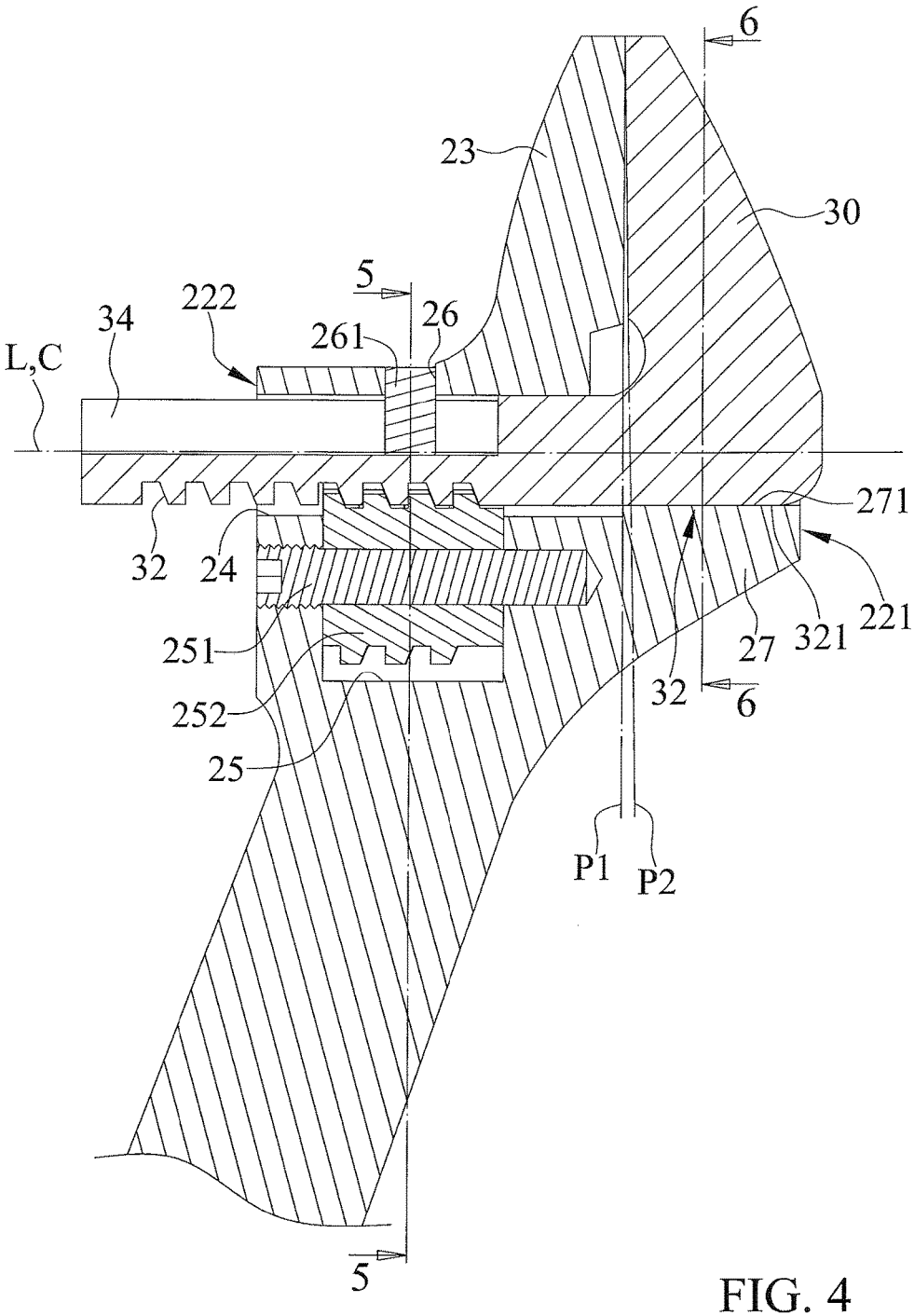
FIG. 4 is a partial, cross sectional view of the adjustable wrench of FIG. 1.
Figure 5:
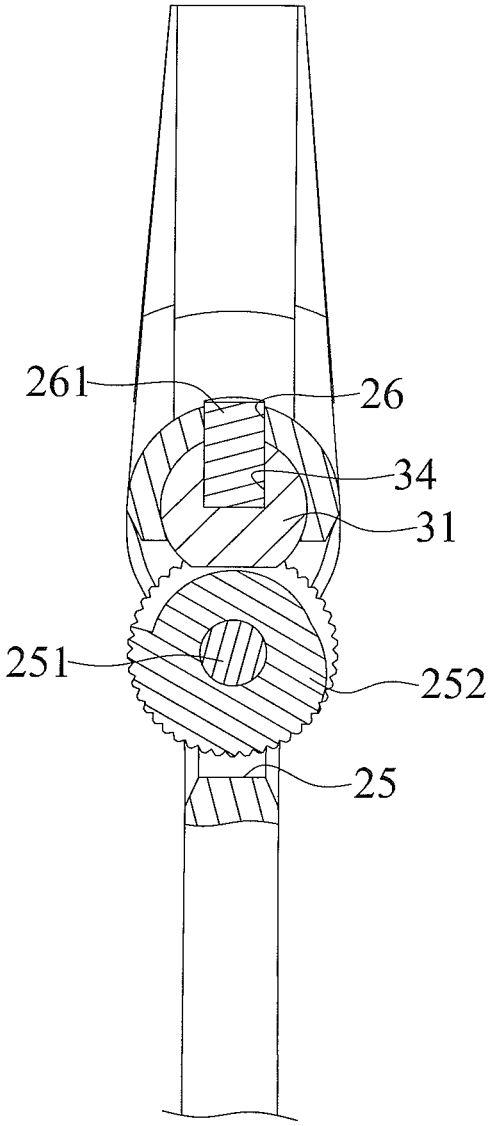
FIG. 5 is a cross sectional view taken along line 5-5 of FIG. 4.
Figure 6:
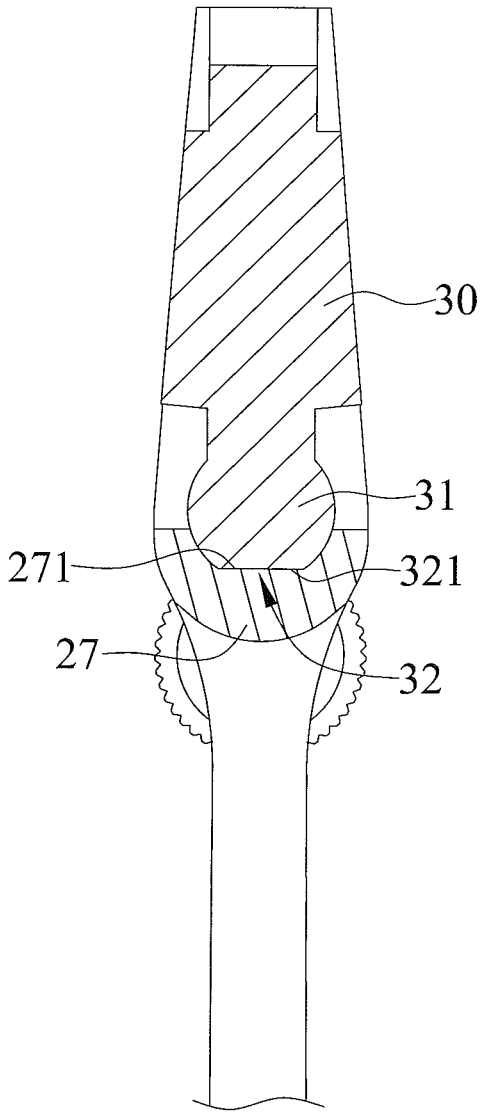
FIG. 6 is a cross sectional view taken along line 6-6 of FIG. 4.
Figure 7:
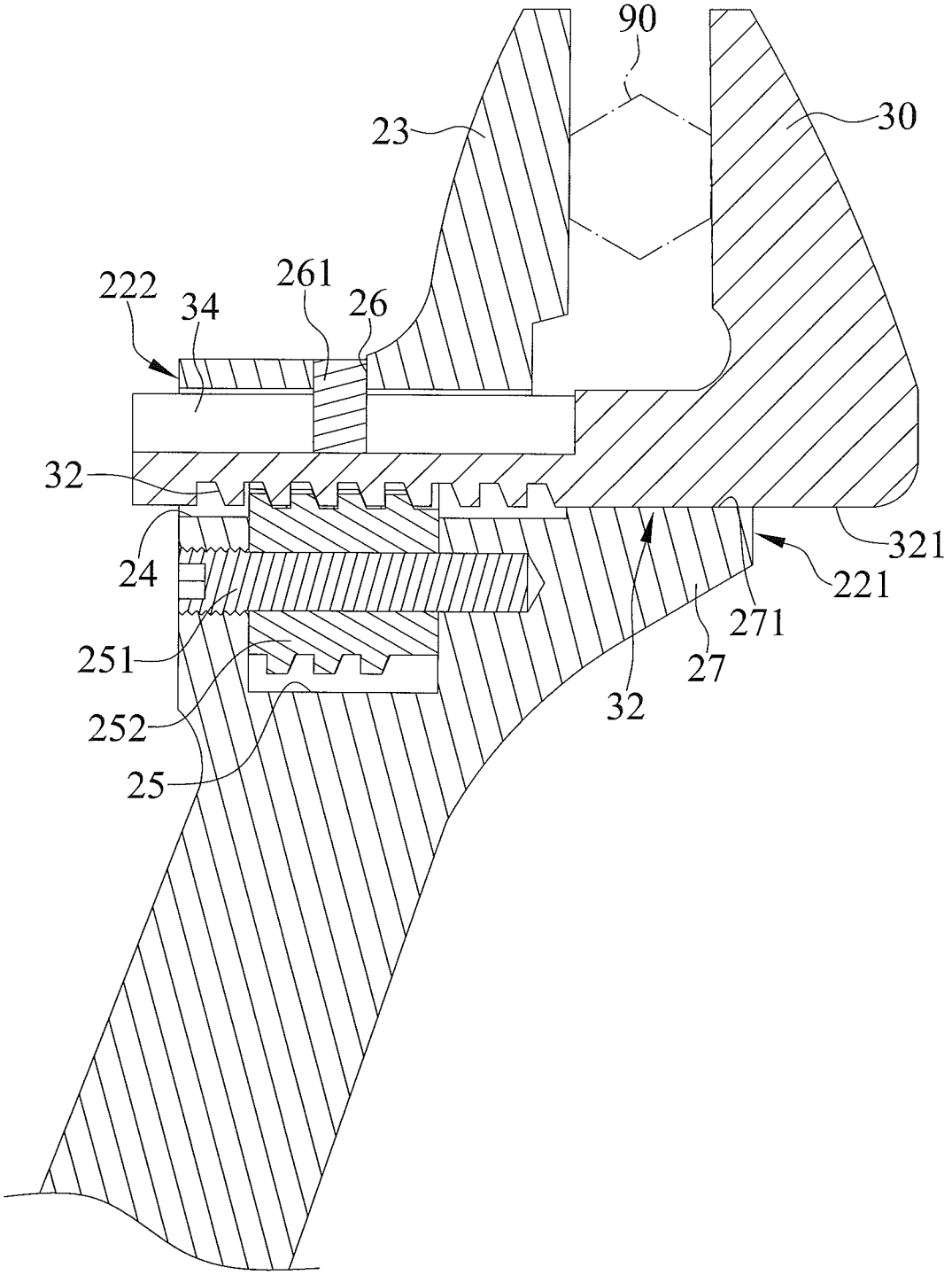
FIG. 7 is a continued view of the adjustable wrench of FIG. 4, illustrating fixed and movable jaws together gripping a workpiece.

All figures are drawn for ease of explanation of the basic teachings only; the extensions of the figures with respect to number, position, relationship, and dimensions of the parts to form the illustrative embodiments will be explained or will be within the skill of the art after the following teachings have been read and understood. Further, the exact dimensions and dimensional proportions to conform to specific force, weight, strength, and similar requirements will likewise be within the skill of the art after the following teachings have been read and understood.

Where used in the various figures of the drawings, the same numerals designate the same or similar parts. Furthermore, when the terms "first", "second", "outer", "top", "bottom", "side", "end", "portion", "section", "longitudinal", "radial", "height", and similar terms are used herein, it should be understood that these terms have reference only to the structure shown in the drawings as it would appear to a person viewing the drawings and are utilized only to facilitate describing the illustrative embodiments.

DETAILED DESCRIPTION

With reference to FIGS. 1-7, an adjustable wrench 10 of a first embodiment according to the present invention includes a frame 20 and a movable jaw 30.

The frame 20 includes a handle 21, a head 22, a fixed jaw 23, a guiding slot 24, and a hole 25. The head 22 is connected to an end of the handle 21. The head 22 includes a first lateral side 221 and a second lateral side 222 opposite to the first lateral side 221. The fixed jaw 23 is formed at a top end of the head 22 opposite to the handle 21, and a working face of the fixed jaw 23 defines a first datum plane P1. The first and second lateral sides 221 and 222 are respectively disposed at two opposite sides of the first datum plane P1. The working face of the fixed jaw 23 faces the first lateral side 221, and a reverse face of the fixed jaw 23 faces the second lateral side 222. The guiding slot 24 extends through the head 22 along an axis L and is formed between the handle 21 and the fixed jaw 23. In the preferred form, the guiding slot 24 communicates with the first and second lateral sides 221 and 222. In this embodiment, the guiding slot 24 substantially has a circular cross-section. The hole 25 is formed through the head 22, and a top section of the hole 25 communicates with the guiding slot 24. The hole 25 is disposed between the first datum plane P1 and the second lateral side 222 and is arranged at a side of the guiding slot 24 opposite to the fixed jaw 23. A pivot 251 inserts into the hole 25 through a direction parallel to the axis L and passes through an adjusting screw 252 rotatably engaged in the hole 25. Thus, the adjusting screw 252 can be rotated about the pivot 251 in the hole 25. In the embodiment, the adjusting screw 252 is a threaded rod.

The frame 20 further includes a groove 26 longitudinally extending through the head 22 and communicates with the guiding slot 24. Moreover, the groove 26 is disposed between the first datum plane P1 and the second lateral side 222. A positioning member 261 inserts through the groove 26. The positioning member 261 and the groove 26 can have any polygonal or circular cross-sections. In the embodiment, the positioning member 261 and the groove 26 substantially have rectangular cross-sections taken along a direction parallel to the axis L, respectively.

Moreover, a holding portion 27 is formed in the head 22 and extends from the first lateral side 221 to an axial extent along the axis L. The holding portion 27 is disposed at an end of the guiding slot 24 opposite to the fixed jaw 23 and includes a holding face 271 disposed in the guiding slot 24. The holding face 271 facing the fixed jaw 23 is flat and extends along a direction parallel to the axis L.

The movable jaw 30 is slidably connected to the head 22 of the frame 20 and faces the fixed jaw 23. A working face of the movable jaw 30 defines a second datum plane P2 parallel to the first datum plane P1, or which is not parallel to the first datum plane P1 to form an included angle of less than two degrees. The movable jaw 30 includes a guiding portion 31, a supporting portion 32, an adjusting portion 33, and a positioning slot 34. The guiding portion 31 is formed along a reference line C and is slidably engaged in the guiding slot 24. Thus, the reference line C and the axis L are alternatively overlaid upon or parallel to each other. In the embodiment, the guiding portion 31 substantially has a circular cross-section to correspond to the guiding slot 24. The supporting portion 32 is formed at a bottom side of the guiding portion 31 and abuts against the holding portion 27. The supporting portion 32 includes an abutting face 321 abutting against the holding face 271 of the holding portion 27. The abutting face 321 is flat and extends along a direction parallel to the reference line C. The adjusting portion 33 is formed at the bottom side of the guiding portion 31 adjacent to the supporting portion 32 and the hole 25 to engage with the adjusting screw 252. In the embodiment, the adjusting portion 33 is a threaded rack. Thus, a user can slide the movable jaw 30 along the guiding slot 24 by turning the adjusting screw 252. The positioning slot 34 extends along the reference line C and corresponds to the groove 26. Thus, the positioning member 261 inserts through the groove 26 to engage into the guiding slot 24 and the positioning slot 34 to prevent shaking of the guiding portion 31 in the guiding slot 24.

When the adjustable wrench 10 turns a workpiece 90, the fixed and movable jaws 23 and 30 suffer a counteracting force produced from the torque applying on the workpiece 90. The reverse face of the fixed jaw 23 has a strong support to increase the structural strength of the fixed jaw 23. The holding portion 27 can support the movable jaw 30 to resist the counteracting force to avoid the deformation of the movable jaw 30. Moreover, the guiding slot 24 has a circular cross-section to securely engage with the guiding portion 31. The head 22 of the frame 20 will not be damaged easily. The adjustable wrench 10 requires fewer components to be easily manufactured and has a lightweight construction.

Figure 8:
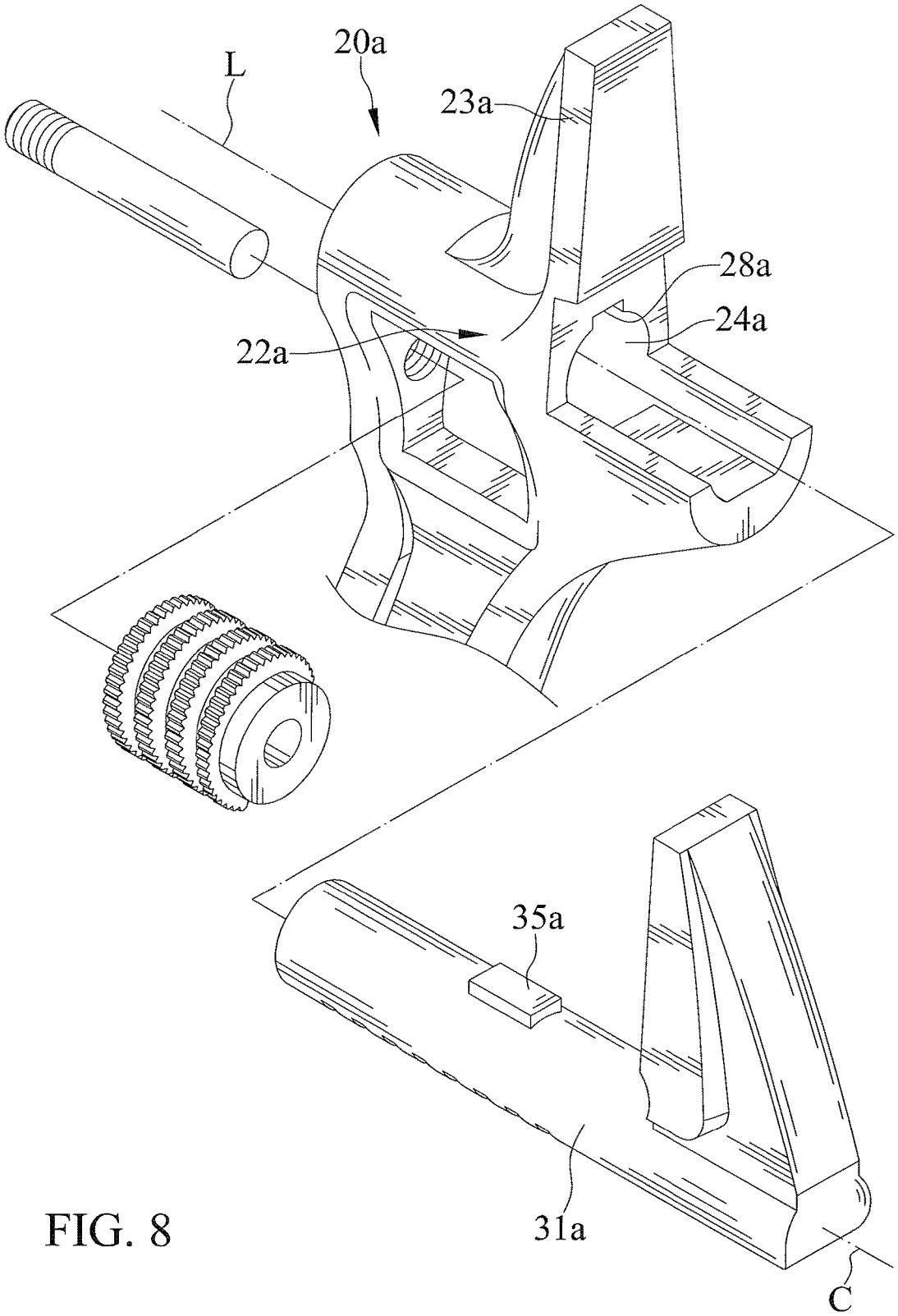
FIG. 8 is a partial, exploded, perspective view of an adjustable wrench of a second embodiment according to the present invention.

FIG. 8 shows an adjustable wrench of a second embodiment according to the present invention. The second embodiment is substantially the same as the first embodiment except that the head 22*a* of the frame 20*a* includes the fixed jaw 23*a* and further includes a positioning recess 28*a* formed at a top side of a periphery of the guiding slot 24*a* along the axis L and communicating with the guiding slot 24*a*. The guiding portion 31*a* includes a positioning portion 35*a* formed at a top side thereof along the reference line C to correspond to the positioning recess 28*a*. The positioning portion 35*a* is engaged in the positioning recess 28*a*.

Figure 9:
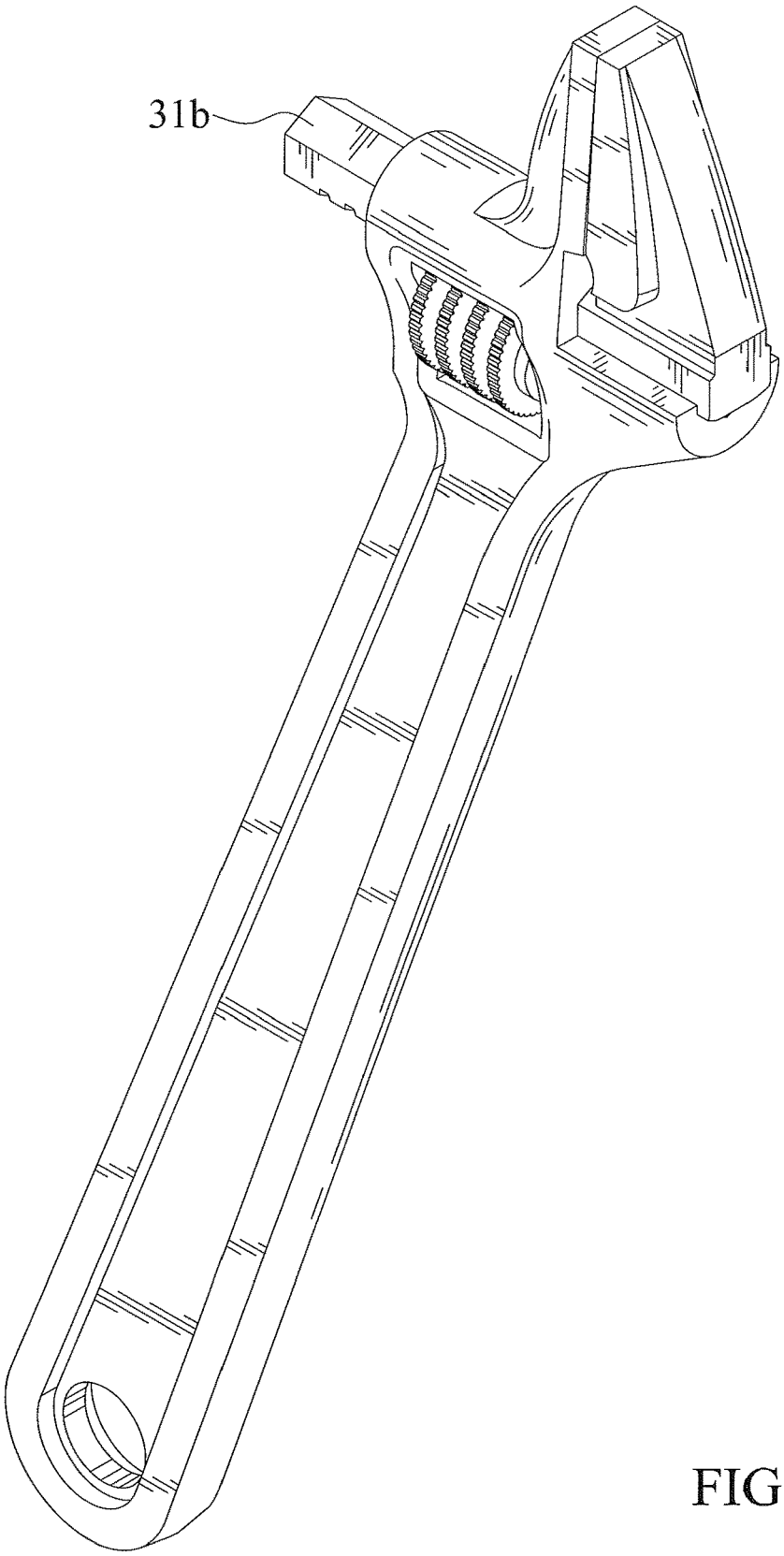
FIG. 9 is a perspective view of an adjustable wrench of a third embodiment according to the present invention.
Figure 10:
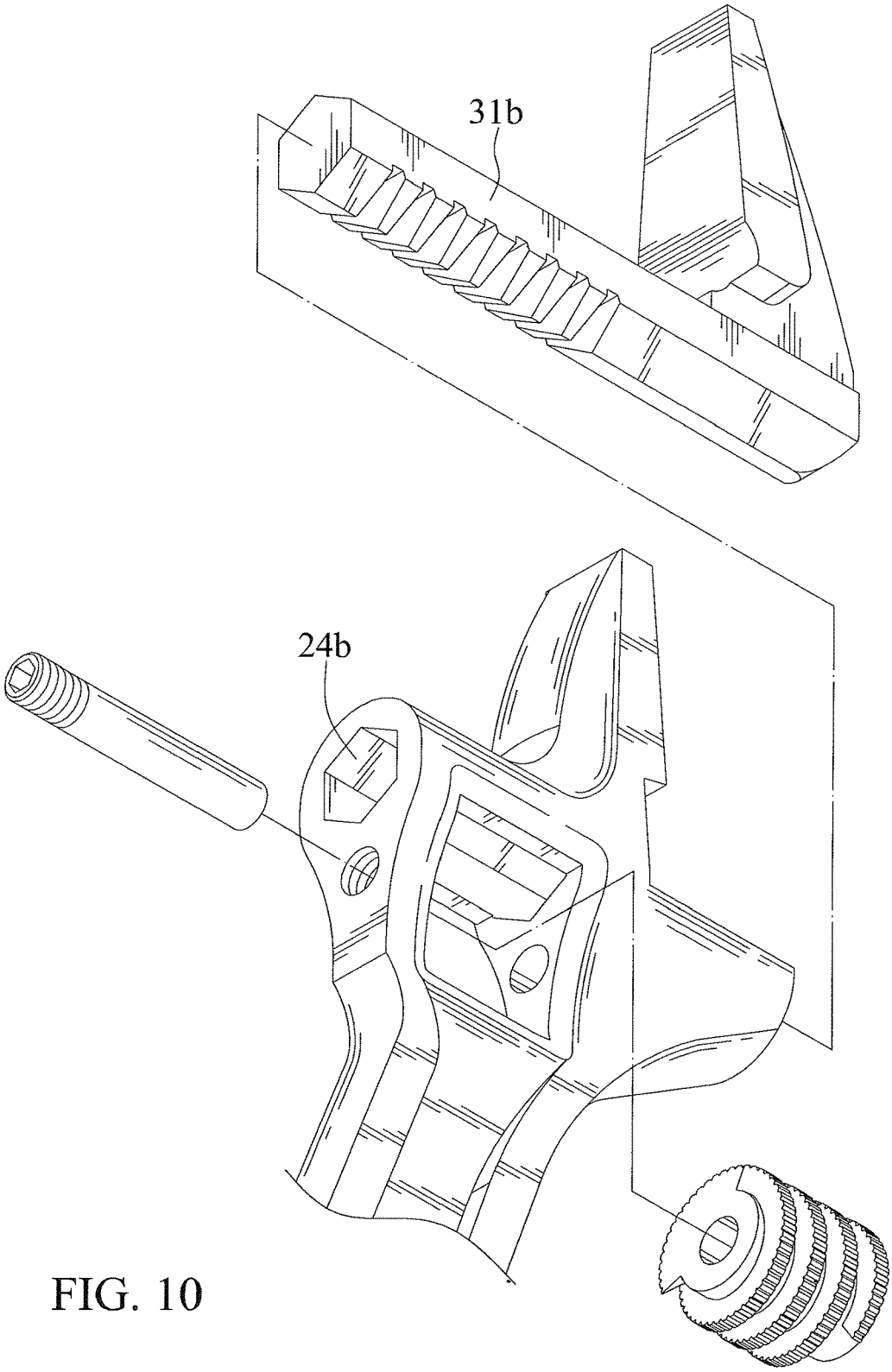
FIG. 10 is a partial, exploded, perspective view of the adjustable wrench of FIG. 9.
Figure 11:
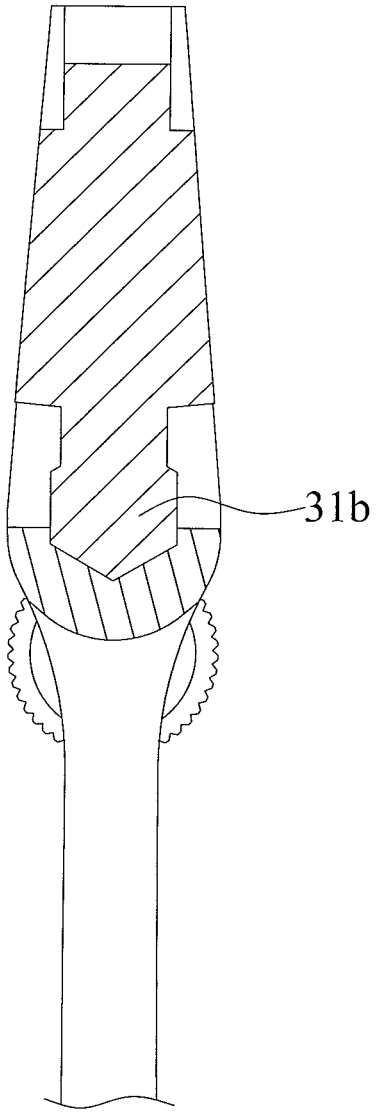
FIG. 11 is a partial, cross sectional view of the adjustable wrench of FIG. 9.

FIGS. 9-11 show an adjustable wrench of a third embodiment according to the present invention. The third embodiment is substantially the same as the first embodiment except that the guiding slot 24*b* and the guiding portion 31*b* substantially have hexangular cross-sections, respectively.

Figure 12:
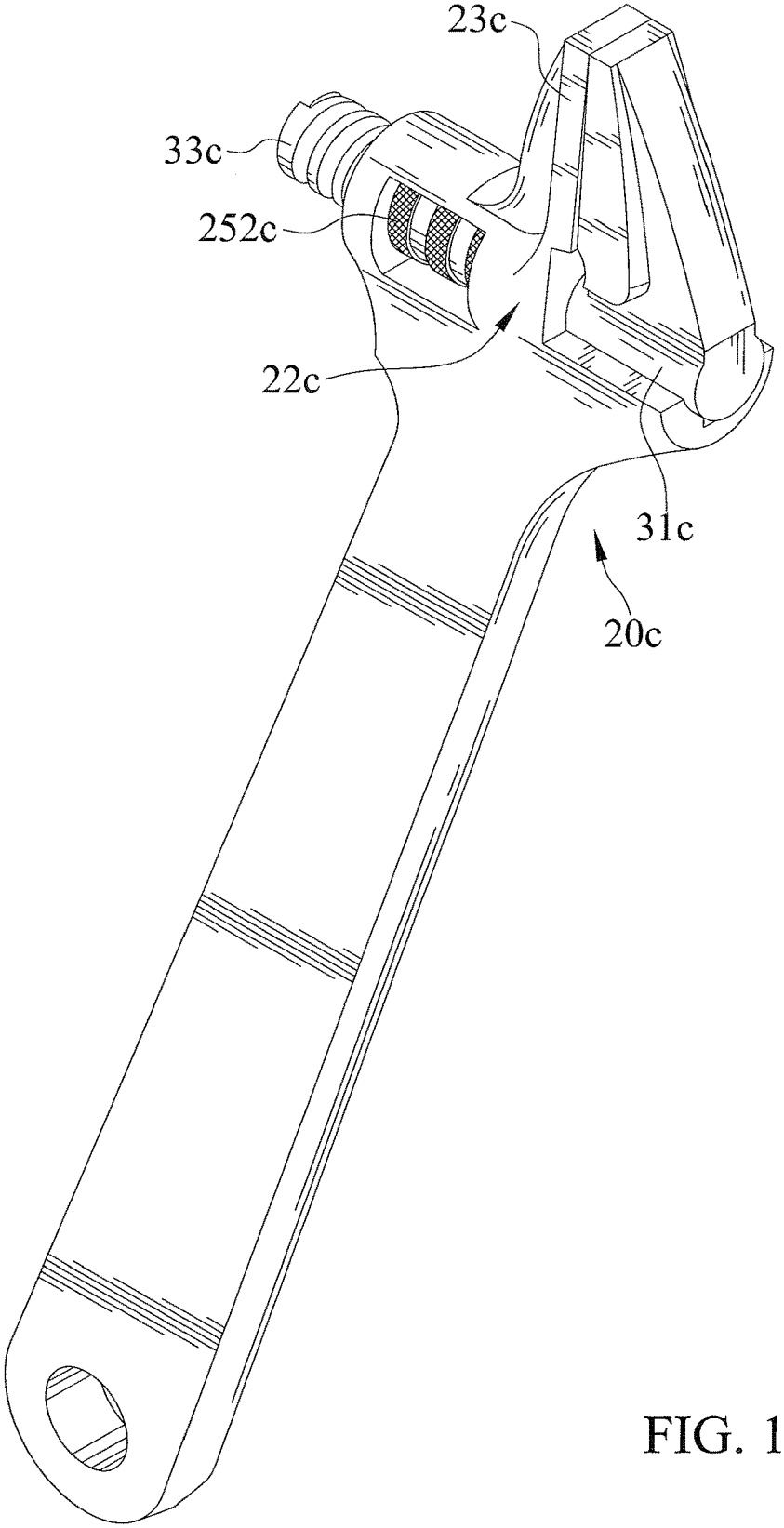
FIG. 12 is a partial, exploded, perspective view of an adjustable wrench of a fourth embodiment according to the present invention.
Figure 13:
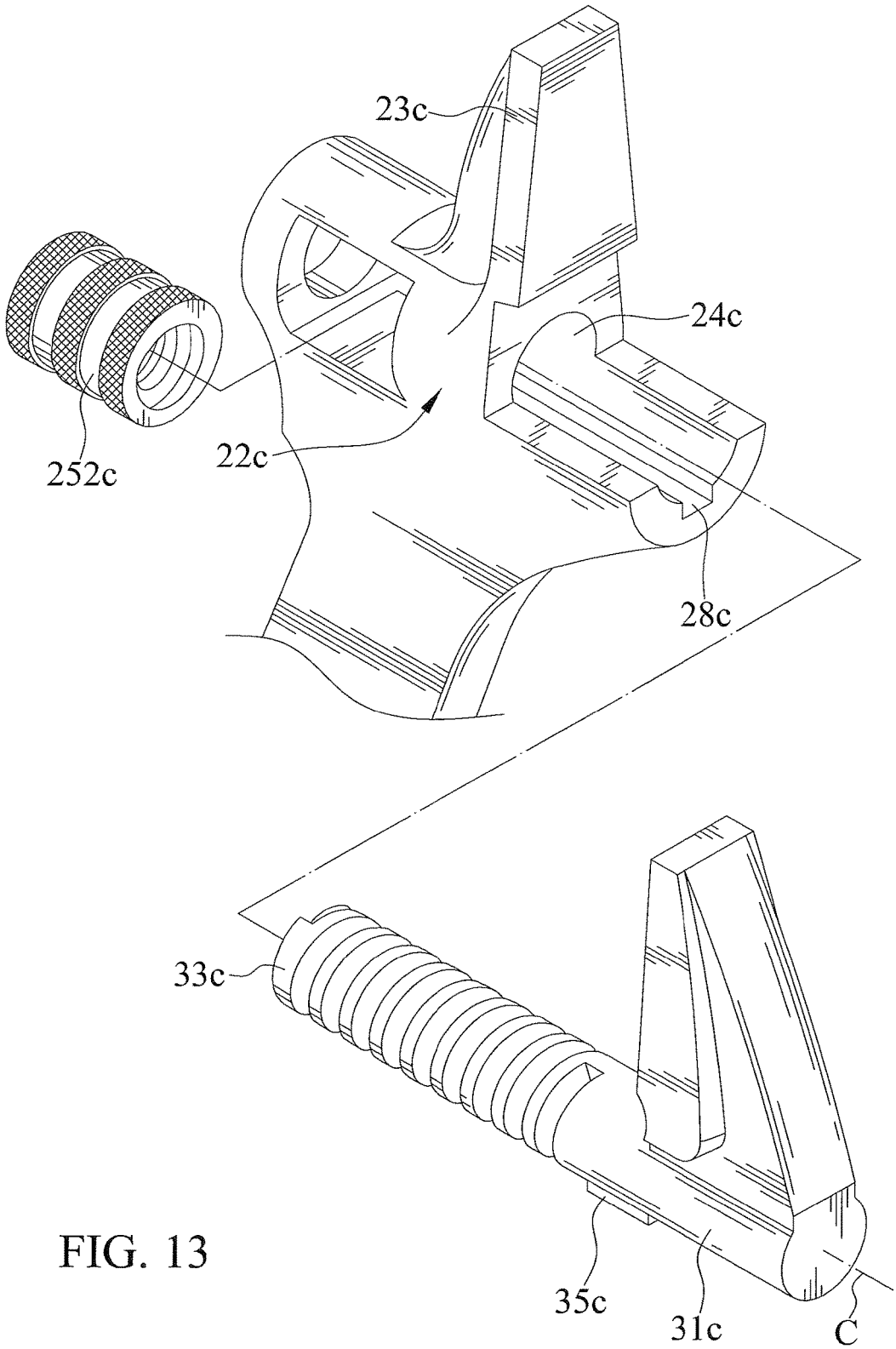
FIG. 13 is a partial, exploded, perspective view of the adjustable wrench of FIG. 12.
Figure 14:
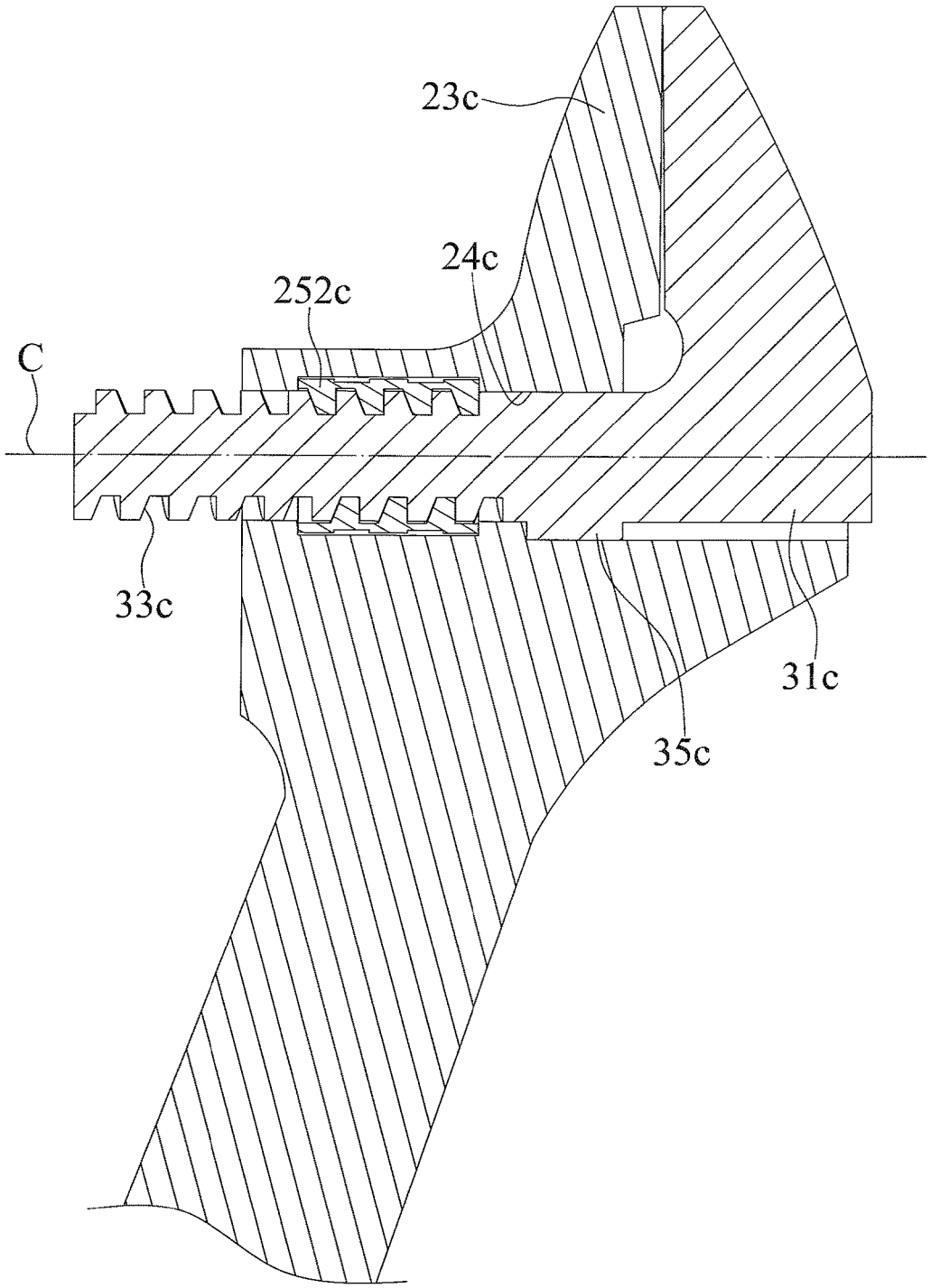
FIG. 14 is a partial, cross sectional view of the adjustable wrench of FIG. 12.

FIGS. 12-14 show an adjustable wrench of a fourth embodiment according to the present invention. The fourth embodiment is substantially the same as the first embodiment except that the adjusting screw 252*c* is a nut with a threaded hole, and the adjusting portion 33*c* is a threaded rod with a threaded section. The threaded hole of the adjusting screw 252*c* is rotatably engaged with the threaded section of the adjusting portion 33*c* along the reference line C. Thus, the user can slide the guiding portion 31*c* along the guiding slot 24*c* by turning the adjusting screw 252*c*.

The head 22*c* of the frame 20*c* includes the fixed jaw 23*c* and further includes a positioning recess 28*c* formed at a bottom side of a periphery of the guiding slot 24*c* and communicating with the guiding slot 24*c*. The guiding portion 31*c* includes a positioning portion 35*c* formed at a bottom side thereof along the reference line C to correspond to the positioning recess 28*c*. The positioning portion 35*c* is engaged in the positioning recess 28*c*.

Although preferred embodiments of the present invention have been illustrated and described, they should not be construed to restrict the scope of the present invention. Therefore, modifications to numerical values, substitution of equivalent elements thereof, or equivalent changes and modifications based on the accompanying claims of the present invention still fall within the scope covered by the present invention.

The invention claimed is:

1. An adjustable wrench comprising:

a frame including a handle, a head connected to an end of the handle, and a fixed jaw formed on an end of the head opposite to the handle, with a working face of the fixed jaw defining a first datum plane, with a guiding slot extending through the head along an axis and formed between the handle and the fixed jaw, with the head including a first lateral side and a second lateral side opposite to the first lateral side, with the first and second lateral sides respectively disposed at two opposite sides of the first datum plane, with the working face of the fixed jaw facing the first lateral side, with a reverse face of the fixed jaw facing the second lateral side, with a hole formed through the head, with a top section of the hole communicating with the guiding slot, with the hole disposed between the first datum plane and the second lateral side, with an adjusting screw rotatably engaged in the hole, with a holding portion formed in the head and extending from the first lateral side to an axial extent parallel to the axis, with the holding portion disposed at an end of the guiding slot opposite to the fixed jaw, with the frame including a groove longitudinally extending through the head and communicating with the guiding slot, with the groove disposed between the first datum plane and the second lateral side; and a movable jaw slidably connected to the head of the frame and facing the fixed jaw, with the movable jaw including a guiding portion formed along a reference line, with the guiding portion slidably engaged in the guiding slot, with the reference line and the axis parallel to each other, with a supporting portion formed at a bottom side of the guiding portion, with the supporting portion abutted against the holding portion, with an adjusting portion formed at the bottom side of the guiding portion adjacent to the supporting portion to engage with the adjusting screw, with the guiding portion including a positioning slot extending along the reference line and corresponding to the groove, with a positioning member inserting through the groove to engage into the guiding slot and the positioning slot.

2. The adjustable wrench as claimed in claim 1, with the holding portion including a holding face disposed in the guiding slot, with the holding face facing the fixed jaw being flat and extending along a direction parallel to the axis, with the supporting portion including an abutting face abutting against the holding face, with the abutting face being flat and extending along a direction parallel to the reference line.

3. The adjustable wrench as claimed in claim 1, with a working face of the movable jaw defining a second datum plane which is not parallel to the first datum plane to form an included angle of less than two degrees.

4. The adjustable wrench as claimed in claim 1, with the guiding slot extending through the head along the axis and communicating with the first and second lateral sides.

5. The adjustable wrench as claimed in claim 1, with the hole arranged at a side of the guiding slot opposite to the fixed jaw, with a pivot inserting into the hole through a direction parallel to the axis and passing through the adjusting screw, with the adjusting portion formed at a side of the guiding portion adjacent to the hole.

6. The adjustable wrench as claimed in claim 1, with the positioning member and the groove substantially having rectangular cross-sections.

7. The adjustable wrench as claimed in claim 6, with the guiding slot and the guiding portion substantially having circular cross-sections.

8. The adjustable wrench as claimed in claim 1, with the holding portion extending from the end of the guiding slot.

9. The adjustable wrench as claimed in claim 8, with the handle further including an opposite end spaced from the end along a handle direction, with the handle adapted to be gripped between the end and the opposite end, with the axis of the guiding guiding slot extending non-parallel to the handle direction, and with the hole extending parallel to and spaced from the axis of the guiding slot and located intermediate the end of the handle and the guiding slot.

10. The adjustable wrench as claimed in claim 1, with the handle further including an opposite end spaced from the end along a handle direction, with the handle adapted to be gripped between the end and the opposite end, with the axis of the guiding slot extending non-parallel to the handle direction, and with the hole extending parallel to and spaced from the axis of the guiding slot and located intermediate the end of the handle and the guiding slot.

* * * * *